US007066547B1

(12) United States Patent
Russell et al.

(10) Patent No.: US 7,066,547 B1
(45) Date of Patent: Jun. 27, 2006

(54) PORTABLE FOOT REST WITH EXTENDIBLE PIVOTAL LEGS

(75) Inventors: Roger L. Russell, 2838 Lincoln Hwy. East, Ronks, PA (US) 17572; John K. Lapp, Jr., New Holland, PA (US); Raymond R. Rutkowski, Denver, PA (US)

(73) Assignee: Roger L. Russell, Ronks, PA (US)

( * ) Notice: Subject to any disclaimer, the term of this patent is extended or adjusted under 35 U.S.C. 154(b) by 0 days.

(21) Appl. No.: 11/177,960

(22) Filed: Jul. 11, 2005

(51) Int. Cl.
*A47C 16/00* (2006.01)

(52) U.S. Cl. ..... 297/423.41; 108/115

(58) Field of Classification Search ..... 297/423.41; 108/127, 128, 129, 132, 120, 115 X
See application file for complete search history.

(56) References Cited

U.S. PATENT DOCUMENTS

| | | | | |
|---|---|---|---|---|
| 172,674 A | | 1/1876 | Tyler | |
| 3,271,075 A | * | 9/1966 | Good | 297/423.41 X |
| 4,228,745 A | | 10/1980 | Gale | |
| 4,462,636 A | | 7/1984 | Markson | |
| 5,244,255 A | | 9/1993 | Mill | |
| 5,316,374 A | | 5/1994 | Fidler | |
| 5,489,144 A | | 2/1996 | Lewis | |
| 6,036,269 A | | 3/2000 | Colton | |

* cited by examiner

*Primary Examiner*—Anthony D. Barfield
(74) *Attorney, Agent, or Firm*—William B. Noll

(57) ABSTRACT

A portable and stabilized foot rest for positioning on a supporting surface, such as a floor, or the like. The foot rest comprises a generally, rectangularly shaped housing mounting a pair of V-configured legs recessible within the housing in a storage or transporting mode, and extendible for use in a foot supporting mode. Plural releasable locking mechanisms are provided to secure the foot rest in the respective modes.

7 Claims, 5 Drawing Sheets

PORTABLE FOOT REST WITH EXTENDIBLE PIVOTAL LEGS

FIELD OF THE INVENTION

This invention is directed to the field of portable foot rests, more particularly to a portable foot rest having two-piece extendible, pivotal legs that may be locked to prevent premature collapsing thereof.

BACKGROUND OF THE INVENTION

The present invention relates to an improved foot rest that can be readily transported by the user, where the foot rest includes a pair of balanced pivotal legs to provide a stationary foot rest and a teeter totter-like foot rest to help in exercising the user's ankles, especially for use by height challenged people.

It is a well known medical phenomenon that physical discomfort in the lower back of a seated person can often be relieved by elevating the feet on a foot rest, footstool or ottoman. Further, the serious complications from dependent edema from prolonged sitting may be reduced by elevating the feet on a foot rest of some sort. People with short legs are also often in need of a foot rest when seated in automobiles, airplanes and other types of chairs because their feet may not reach the floor, and excessive forces are consequently put on one's thighs.

The prior art offers a number of proposed solutions for such people, where the following U.S. patents reflect several of such solutions:

a.) No. 5,489,144, to Lewis, teaches a foot stool for supporting the legs of an individual relative to a ground surface. The device includes a support member for receiving the individual's legs. A folding leg assembly positions the support member above the ground and can be folded flatly against the support member for storage and/or transportation purposes.

b.) No. 5,316,374, to Fidler, covers a portable foot rest that includes first and second side plates hingedly mounted together, first and second end plates hingedly mounted to a first side plate, and at least one end plate slot to receive lug portions of the second end plate. The foot rest is arranged for interfolding relative to the plate structure for securement to a portable container to permit ease of transport and storage.

c.) No. 5,244,255, to Hill, discloses a folding foot rest having a thin, flat rectangular platform with a foot-supporting upper surface and hinges at two opposed short sides that pivotally connect to a pair of flat legs. The legs support the platform in an elevated position above a surface on which the legs rest. This provides an elevated foot rest, especially for the seated short person. The hinges permit the legs to swing from the vertical operative position in which both legs are parallel to one another and extended downward at right angles to the platform to the folded, transport position lying flat on top of the upper surface of the platform. By covering the soiled foot-supporting surface of the platform with the folded legs, a more sanitary folded package is provided for carrying in pocket or purse. The hinge cooperates with the legs and platform to stop the legs from moving toward one another when in the operative position. A removable strut extends between and engages both legs in the operative position to prevent the legs from moving away from one another. The strut also serves as a toe hold for moving the foot rest about.

d.) No. 4,462,636, to Markson, is directed a collapsible footstool that includes a platform and a pair of legs adapted to support the platform in an elevated position. The legs are hinged to the platform so that they can be folded inwardly below the platform with stop means for preventing outward movement of the legs beyond positions in which they support the platform. Bracing means are provided and include respective struts pivotally coupled to the underside of the platform and adapted to cooperate with the legs for bracing them in their operative positions.

e.) No. 4,228,745, to Gale, teaches a footstool which is variable in both its height and its slope to accommodate the varying needs of individuals who are required to hold a leg in an elevated position for extended periods of time. The stool includes a main body portion having adjustable legs at each end and which may be hinged to the main body portion for convenience in transport and storage. Each of the legs is formed of a base portion and a portion fixed to the main body portion of the stool with an infinitely variable adjustment member such as a screw anchored in one of the leg portions and a mating nut mounted in the other of the leg portions. Preferably, the legs extend downwardly from the main body portion at diverging angles, in their use position, to enhance the longitudinal stability of the stool. Lateral stability and overall stability are provided by widely separated guides in each leg which provide both lateral and longitudinal guidance and bracing on both sides of each of the leg adjusters. The leg portions, which are fixed with respect to the main body portion, may be latched in their use position to provide an essentially rigid joint between the main body portion and that portion of the leg.

f.) No. 172,674, to Tyler, relates to a padded foot stool that includes a pair of pivotal legs to elevate the padded foot stool.

Though the foregoing prior art offer a number of proposals for portable foot rests, they are all of the static types that merely rest on a supporting surface, such as a floor. None provide the versatility of the portable foot rest of the present invention, where the pivotal legs thereof are spaced inwardly from the platform ends to allow the user to exercise and move one's ankles through a teeter-totter motion. The manner by which the present invention achieves such goal will become clearer in the specification which follows, especially when read in conjunction with the accompanying drawings.

SUMMARY OF THE INVENTION

The present invention is directed to a versatile and portable foot rest that functions as a stable foot rest resting on a supporting surface, i.e. floor, while further offering the user the opportunity to exercise one's feet through the positioning of a pair of pivotal legs inwardly from the ends. By this arrangement, one can exercise the ankles with a teeter-totter motion about the respective pivot points of the legs. The portable and pivotal foot rest of this invention comprises a generally rectangular housing with a planar upper surface, a pair of elongated side edges, and a pair of shorter ends joined with said side edges. The housing is further characterized by a downwardly extending peripheral side wall for receiving a pair of recessible, pivotal legs in an inoperative and transportable mode. In the operative or foot supporting mode, the legs may be pivoted about a mid-portion thereof and conveniently and releasably locked, where the respective legs form a V-configured leg. The mid-portion further features a flexible, elastomeric covering to minimize or eliminate sliding of the foot rest. By positioning the mid-portions of the respective legs inwardly from the shorter ends, preferably about 16 to 18% from the respective shorter ends, the user thereof can easily pivot about the mid-portions, i.e. in a teeter-totter motion, to effect movement and thus exercising of the user's ankles. To facilitate manual transporting of the foot rest hereof, at least one transverse slot may be provided to accommodate the user's fingers.

Accordingly, a feature of the invention is the provision of a portable and stable foot rest having the versatility of a pivotal exercising device for the user's ankles.

Another feature hereof lies in the use of a pair of V-configured that may be recessed within the housing of the foot rest, and extendible and lockable in a foot supporting mode.

Still a further feature of the invention is the provision of a pair of V-configured legs having slip resistant supporting edges.

These and other features of the invention will become clearer from the specification and drawings which follow.

DETAILED DESCRIPTION OF PREFERRED EMBODIMENT

Figure 1:
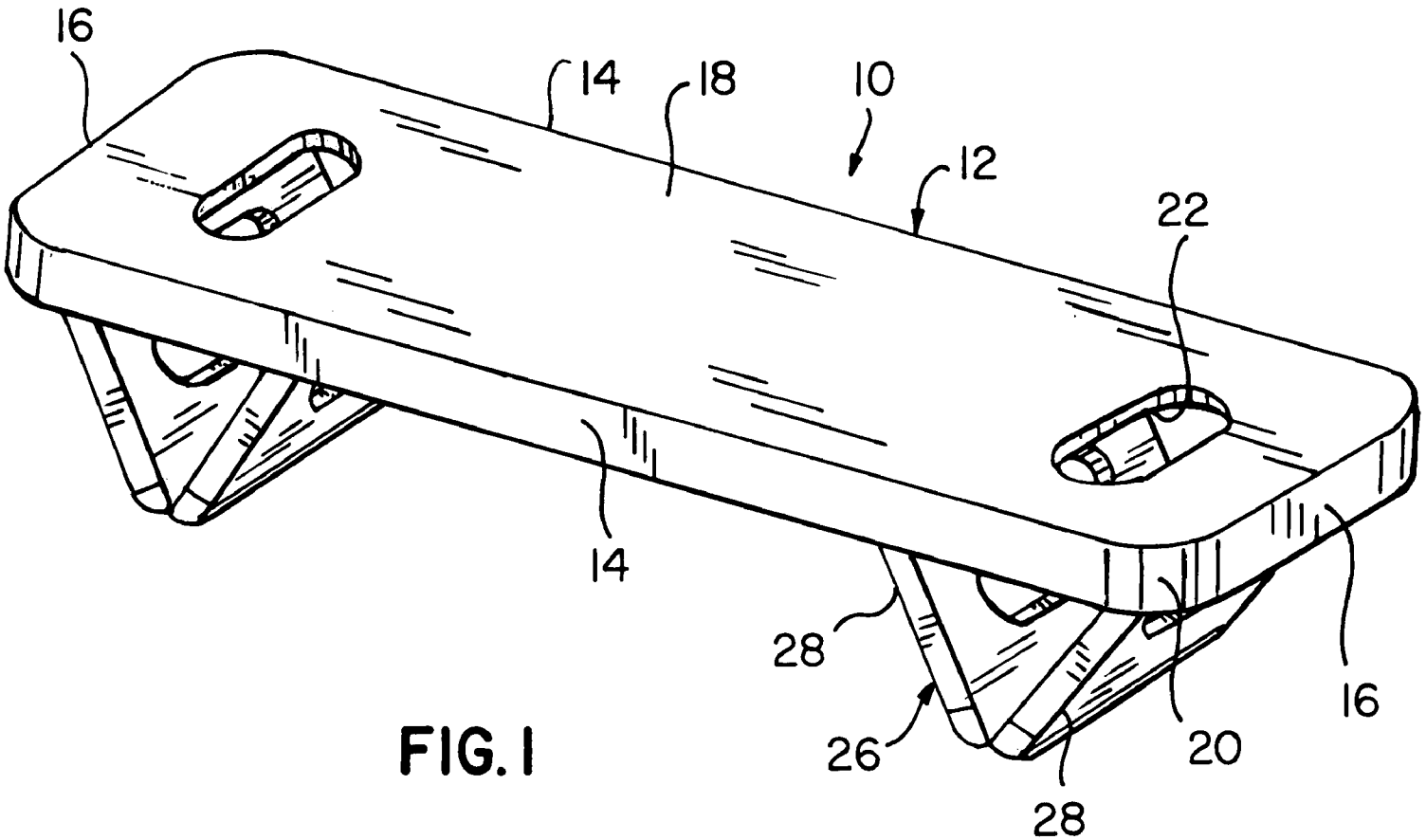
FIG. 1 is a perspective view of the foot rest of the invention showing the foot rest hereof in a leg extended or operable position for receiving and supporting a user's foot.
Figure 2:
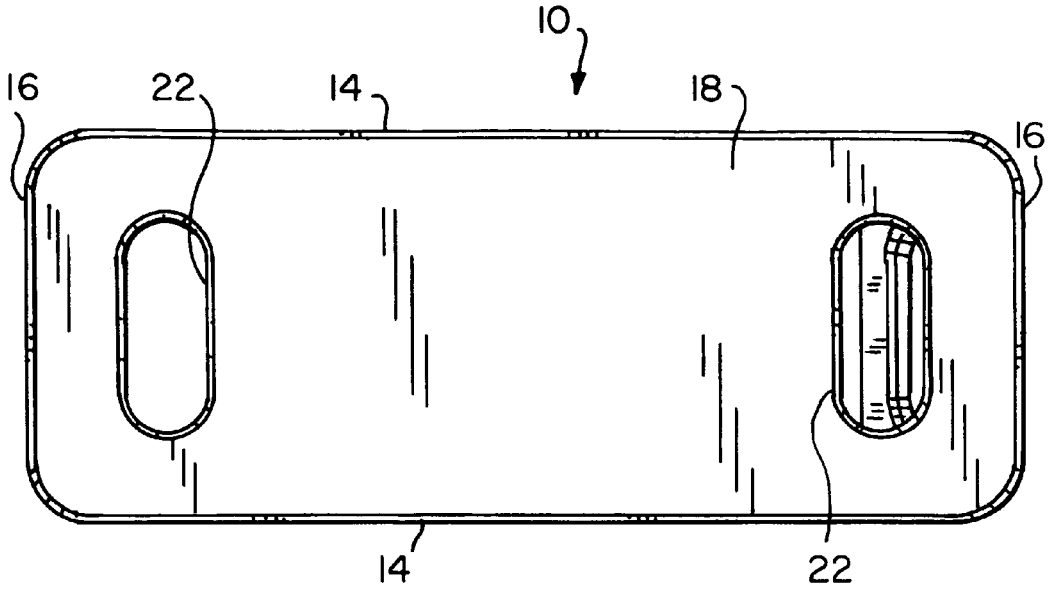
FIG. 2 is a top view thereof.
Figure 4:
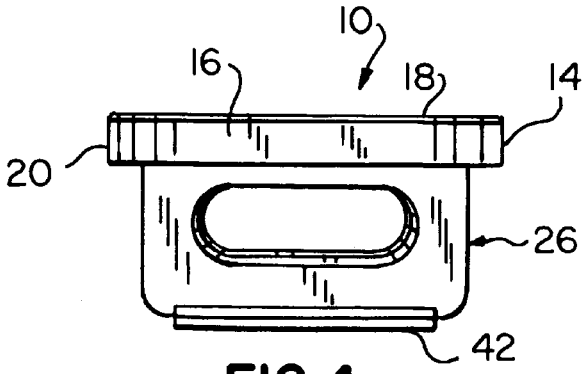
FIG. 4 is an end view of the foot rest of FIG. 3.

This invention relates to a portable, stable foot rest that is versatile in its ability to offer the user a stable foot rest, and an ankle exercising device while positioned on a supporting surface, such as a floor. The invention will now be described with regard to the several Figures, where like reference numerals represent like components or features throughout the various views.

Turning now to FIGS. 1 through 8, illustrating various views of the foot rest 10 of the invention, preferably fabricated of plastic, such as PVC, as known in the art, the foot rest comprises a generally rectangular housing 12 formed by a pair of parallel sides 14, a pair of ends 16 extending between said sides 14, a planar upper, foot supporting surface 18, and a downwardly extending, continuous, peripheral wall 20. Further, the housing opening to the foot supporting surface 18 may include one or more through openings 22 in proximity to the ends 16 for use in hand gripping and transporting the foot rest 10.

Figure 7:
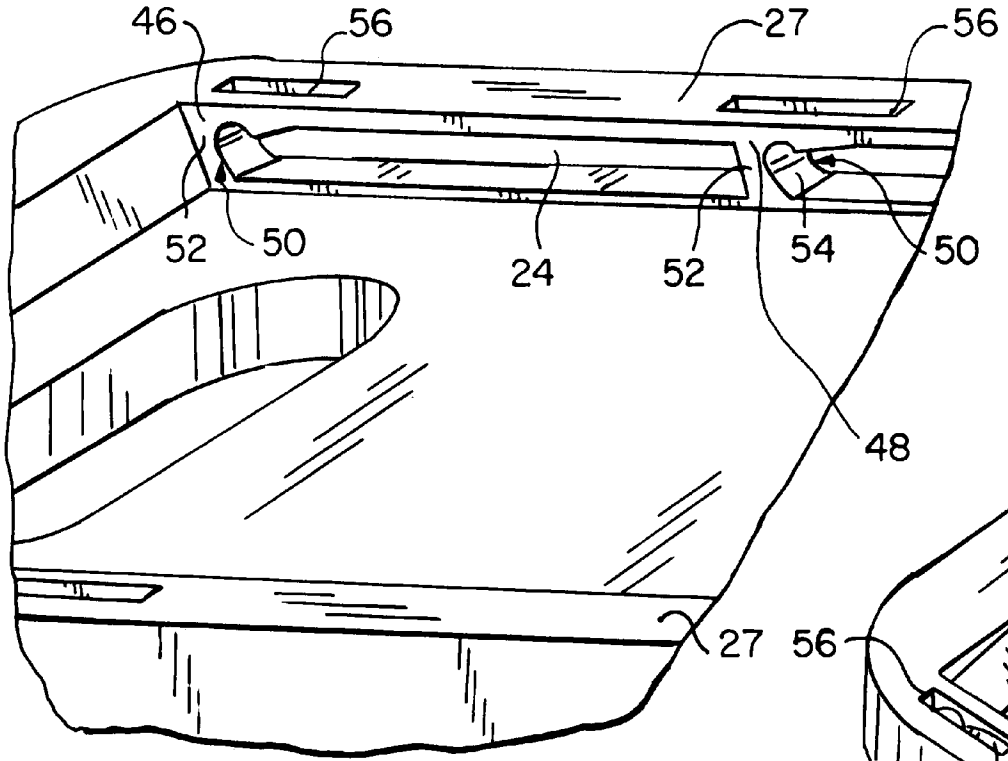
FIG. 7 is an enlarged, partial, inside perspective view showing a releasable locking member for the movable and pivotal leg of the invention.
Figure 8:
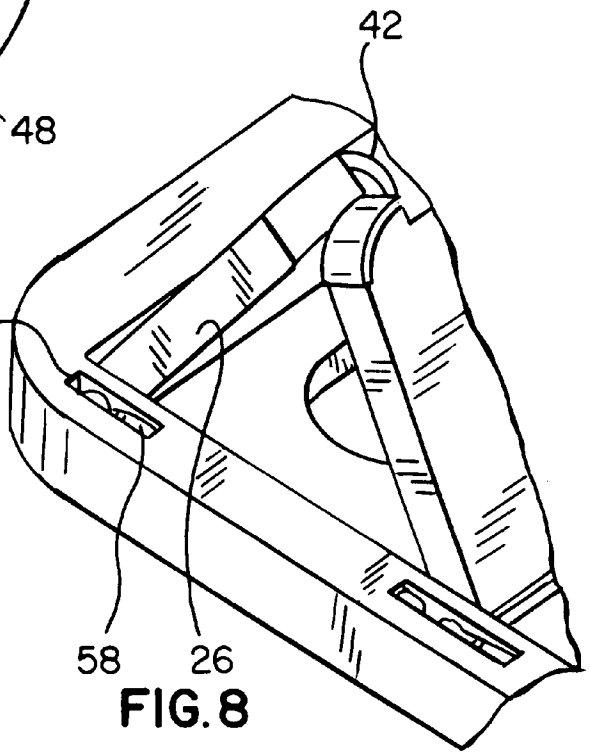
FIG. 8 is an enlarged, partial, bottom perspective view showing a flexible, cantilevered arm forming part of the releasable locking mechanism for the movable and pivotal legs.

As best illustrated in the partial view of FIGS. 7 and 8, the peripheral wall 20, at least along the respective sides 14, includes an inwardly directed slot 24 or channel for sliding receipt of the pair of V-configured legs 26, described in greater detail hereafter, where the slot 24 is further defined by an inwardly directed wall 27.

Figure 5:
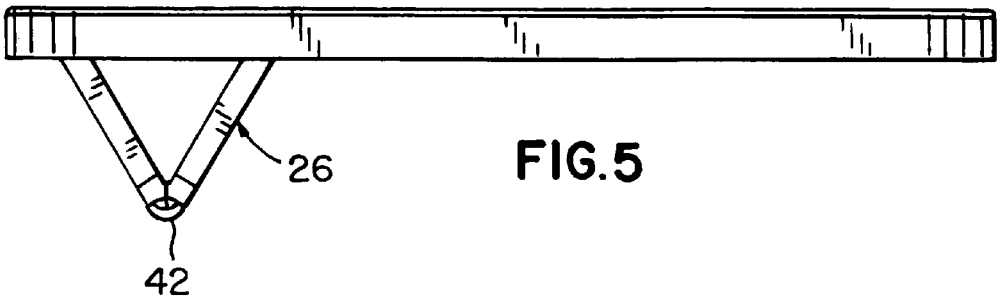
FIG. 5 is a side view thereof
Figure 3:
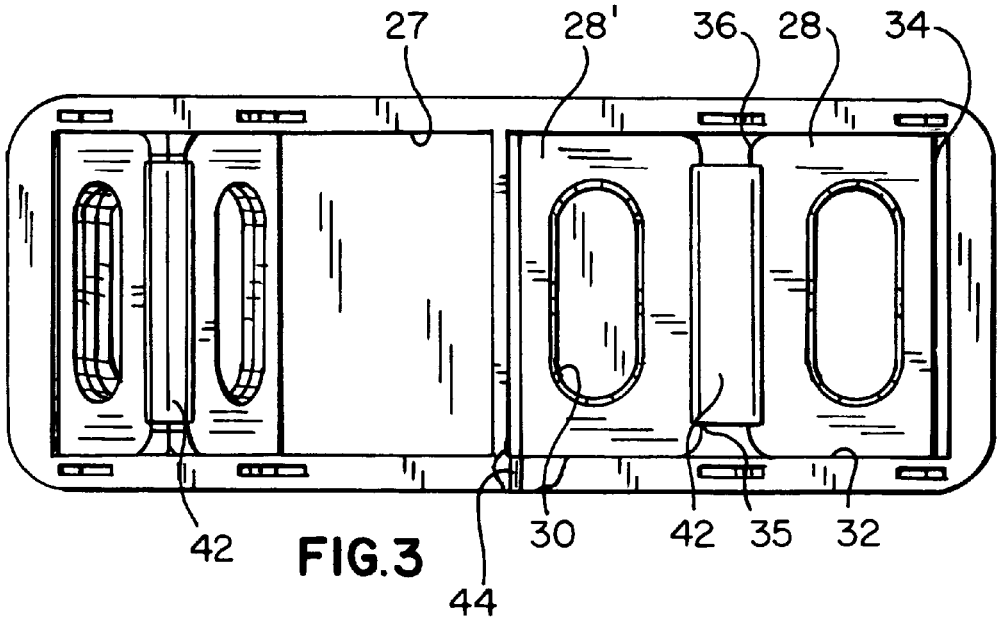
FIG. 3 is a bottom view thereof showing one extended leg mechanism, showing a small section removed to illustrate a hidden detail.
Figure 6:
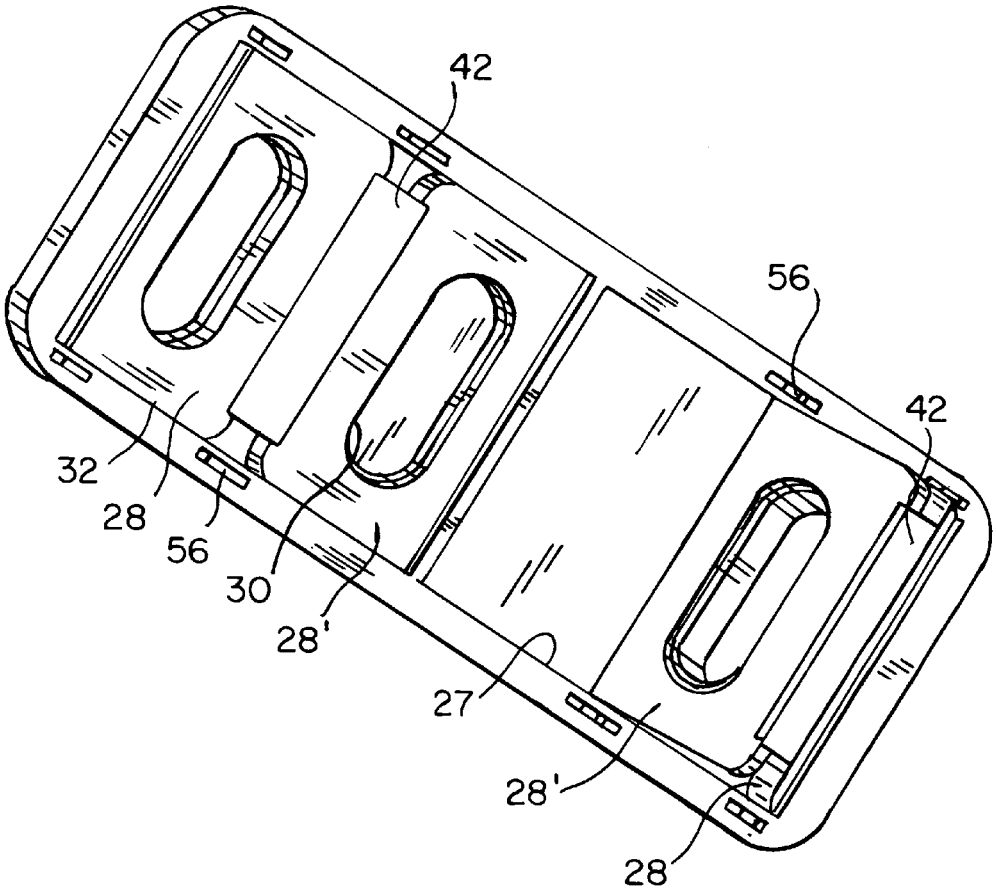
FIG. 6 is a bottom perspective view showing the foot rest of FIG. 3.

The V-configured legs 26, shown in the several Figures, each comprise a pair of leg sections 28, 28' with central openings 30, where a first said leg section 28 is defined by a pair of parallel side edges 32, a top edge 34 arranged for pivotal movement with said slot 24, and a lower edge 36. The second leg section 28' is defined by a pair of parallel side edges 38, a top edge 40, as explained later, and is arranged for sliding and releasable locking within the slot 24. Finally, the second leg section 28' further includes a lower edge 35 for hingedly mating with the first leg section 28 along its lower edge 36. Specifically, the respective leg sections 28, 28' are hinged by an elastomeric member 42, such as a thin, flexible rubber member, as best seen in FIGS. 3 and 5, to provide an anti-slipping grip when the foot rest is positioned on the floor or other suitable supporting surface. By this arrangement, the user can exercise one's ankle by pivoting the foot rest about either of the stabilized V-configured legs 26.

To facilitate releasable locking of the respective legs 26 in a foot supporting or exercising mode, reference is made to FIGS. 3, 7 and 8. Specifically, the respective side edges 32, 38, in proximity to the top edges 34, 40, respectively, are provided with an outwardly extending pin 44 (FIG. 3) for sliding along the slot 24 or channel, only one pin 44 being shown. Since the foot rest 10 is preferably fabricated of plastic, the outside ends 46 and a midpoint location 48 along said slot 24 may be provided with an in-molded locking mechanism 50. The locking mechanism 50, though other mechanisms may be used, preferably comprises a broad faced member 52 having a curved face 54 for engaging an appropriate pin 44. For releasably securing the pin 44, the lower edge or wall 27 includes plural through slots 56, one positioned at the respective locking mechanism 50. The through slots 56 include a flexible, cantilever arm 58 (FIG. 8). By this arrangement, the user can easily move and pivot a leg 26 into temporary latching until the user desires to release the legs 26 and return the device to a flat storage or transporting mode.

It is recognized that changes, modifications and variations may be made to the foot rest of this invention without departing from the spirit and scope thereof. Accordingly, no limitation is intended to be imposed thereon except as set forth in the accompanying claims.

We claim:

1. A portable and stabilized foot rest for positioning on a supporting surface, where said foot rest allows for exercising the user's ankle through pivoting of said foot rest on said supporting surface, said foot rest comprising:

a housing member defined by a pair of side edges characterized by inwardly directed channels open to a lower surface, a pair of end edges joined to said sides edges to form a generally rectangular shape, and a generally upper planar surface and a lower surface; and, a pair of V-configured legs, each said leg comprising first and second leg sections hinged along mating edges and mounted for recessing within said housing in a storage mode, and extendible in a resting and exercising mode for contact with said supporting surface, a said first leg section mounted for pivoting action within said channels, and said second leg section mounted for sliding movement between said respective modes, where said legs further mount outwardly extending pins for sliding movement along a respective said channel, said housing including releasable locking mechanisms to secure the foot rest in said respective modes.

2. The portable and stabilized foot rest according to claim 1, wherein the said leg sections of a given said V-configured leg are by a hinging member.

3. The portable and stabilized foot rest according to claim 2, wherein said hinging member comprises a thin, slip preventing, rubberized member to stabilize said foot rest on said supporting surface.

4. The portable and stabilized foot rest according to claim 1, wherein said housing member includes at least one transverse opening aligned with a complementary opening in said first leg section, where said aligned opening may function as a hand grip for transporting said foot rest in said storage mode.

5. The portable and stabilized foot rest according to claim 1, including a rubberized, flexible catch within said channels for contacting and supporting said first leg section in said mode.

6. The portable and stabilized foot rest according to claim 1, including inwardly directed flanges to further define said channels having spaced apart access openings to release said locking mechanisms.

7. The portable and stabilized foot rest according to claim 6, where said locking mechanism each comprise a member extending within said channel, said member characterized by a pin receiving recess and a flexible arm accessible to said member through an opening in a said inwardly directed flange.

* * * * *